US006972388B2

(12) United States Patent
Dahl et al.

(10) Patent No.: US 6,972,388 B2
(45) Date of Patent: Dec. 6, 2005

(54) POWER CIRCUIT BREAKER

(75) Inventors: Joerg-Uwe Dahl, Werder (DE); Michael Kruschke, Schwante (DE); Marc Liebetruth, Glienicke (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/845,420

(22) Filed: May 14, 2004

(65) Prior Publication Data

US 2004/0226811 A1 Nov. 18, 2004

(30) Foreign Application Priority Data

May 16, 2003 (DE) ..... 103 23 094

(51) Int. Cl.[7] ..... H01H 5/00
(52) U.S. Cl. ..... 200/400; 200/401
(58) Field of Search ..... 200/400, 401, 200/303, 293, 307, 50.32, 50.33, 50.37, 50.4, 200/17 R; 335/159–161, 185–190

(56) References Cited

U.S. PATENT DOCUMENTS

| | | | | |
|---|---|---|---|---|
| 3,590,192 A | | 6/1971 | Bould et al. | |
| 4,598,186 A | | 7/1986 | Cook et al. | |
| 4,649,247 A | * | 3/1987 | Preuss et al. | 200/244 |
| 4,729,248 A | * | 3/1988 | Godesa | 74/2 |
| 4,746,778 A | * | 5/1988 | Marquardt | 200/538 |
| 4,884,047 A | | 11/1989 | Baginski et al. | |
| 4,899,253 A | | 2/1990 | Buxton | |
| 5,981,888 A | * | 11/1999 | Robarge et al. | 200/400 |
| 6,249,197 B1 | * | 6/2001 | Zindler et al. | 335/202 |
| 6,444,934 B1 | * | 9/2002 | Imura et al. | 200/400 |
| 6,777,636 B2 | * | 8/2004 | Ahlert et al. | 200/401 |
| 6,838,626 B2 | * | 1/2005 | Deylitz et al. | 200/50.21 |

FOREIGN PATENT DOCUMENTS

| | | |
|---|---|---|
| DE | 197 39 702 C1 | 12/1998 |
| EP | 0 320 412 B1 | 12/1988 |
| EP | 0 853 326 A2 | 12/1997 |

* cited by examiner

*Primary Examiner*—Michael Friedhofer
*Assistant Examiner*—Lisa Klaus
(74) *Attorney, Agent, or Firm*—Harness, Dickey & Pierce, P.L.C.

(57) ABSTRACT

A power circuit breaker includes a switching pole enclosure for accommodating at least one switching pole, whose switching contacts, when closed, rest against one another on a predetermined contact plane. It further includes a switching shaft for transferring drive forces to the at least one switching pole. The switching pole enclosure includes a first and a second enclosure shell, which rest against one another along a separating joint running essentially parallel to the contact plane, and in which the switching shaft is mounted by use of at least two switching shaft mounts held on the first enclosure shell. At least one first and one second fastening device, each serving the purpose of connecting the two enclosure shells, is in each case supported on the one hand on the second enclosure shell and on the other hand on one of the switching shaft mounts.

14 Claims, 1 Drawing Sheet

(B-B)

POWER CIRCUIT BREAKER

The present application hereby claims priority under 35 U.S.C. §119 on German patent application number DE 103 23 094.7 filed May 16, 2003, the entire contents of which are hereby incorporated herein by reference.

FIELD OF THE INVENTION

The invention generally relates to a power circuit breaker.

BACKGROUND OF THE INVENTION

In the event of a short circuit, high operating forces, such as gas pressure forces and current loop forces, occur in power breakers. These have an effect on the components concerned, in particular the enclosure parts which are screwed to one another and which contain the switching chambers, the contact supports, the switching shaft and the mount and support for the switching shaft which are deformed when subjected to the loads. This deformation, in particular owing to the associated reduction in the contact forces on the interacting switching contacts, reduces the ability of the power breaker to withstand surge currents.

A known measure for avoiding this problem is to increase the contact forces. However, this also brings with it an increase in the drive forces and thus a need to increase the dimensions of all of the drive parts.

U.S. Pat. No. 4,899,253 further discloses a way of improving the robustness of an assembled breaker enclosure using interlocking device(s) such as, in particular, dovetailed strips and corresponding grooves. However, these device(s) only affect the width and not the depth of the breaker.

In addition to the problems involved with the required insulation, an enclosure design having steel components or the like is outdated now, not cost-effective and difficult to work with.

SUMMARY OF THE INVENTION

It is therefore an object of an embodiment of the invention to avoid the disadvantages of the known prior art and to create a power circuit breaker which is distinguished by a design which is simple to realize and is subject to little deformation and is able to withstand high surge currents with low required contact forces.

An object may be achieved according to an embodiment of the invention by at least one first and one second fastening device, each serving the purpose of connecting the two enclosure shells, being in each case supported on the one hand on the second enclosure shell and on the other hand on one of the switching shaft mounts. With a design such as this, the force thus flows via the second enclosure shell and the fastening device directly to the switching shaft mounts and the switching shaft.

The bending resistance of the switching shaft thus contributes to relieving the load on the first enclosure shell such that this first enclosure shell can thus correspondingly be formed such that it is not as robust as the second enclosure shell. This makes it possible to achieve a design for the power circuit breaker which can be realized simply, is subject to little deformation, and has an advantageous geometry. The fact that it is subject to little deformation ensures that it is able to withstand high surge currents with small contact forces being required.

One preferred refinement of an embodiment of the invention provides for the second enclosure shell to be ribbed.

This reduces the deformability of the second enclosure shell and thus of the remaining components which are directly or indirectly connected to it, as a result of which the ability to withstand surge currents is increased.

In the case of a power circuit breaker in which the switching pole enclosure has pole partitions for the purpose of physically separating adjacent switching poles and in which the two enclosure shells form outer side walls, a further preferred refinement of an embodiment of the invention provides for at least one of the fastening devices to extend in one of the pole partitions and/or one of the side walls. In this manner, there is no need for any additional physical space, in particular any physical space in the switching chambers. Furthermore, no additional insulation is required for the at least one fastening device as a result of this, since the respective pole partition or the respective outer side wall is self-insulating. Tie rods may advantageously be provided as the fastening device.

BRIEF DESCRIPTION OF THE DRAWINGS

The present invention will become more fully understood from the detailed description of preferred exemplary embodiments given hereinbelow and the accompanying drawing, which is given by way of illustration only and thus are not limitative of the present invention, and wherein.

DETAILED DESCRIPTION OF THE PREFERRED EMBODIMENTS

Figure 1:
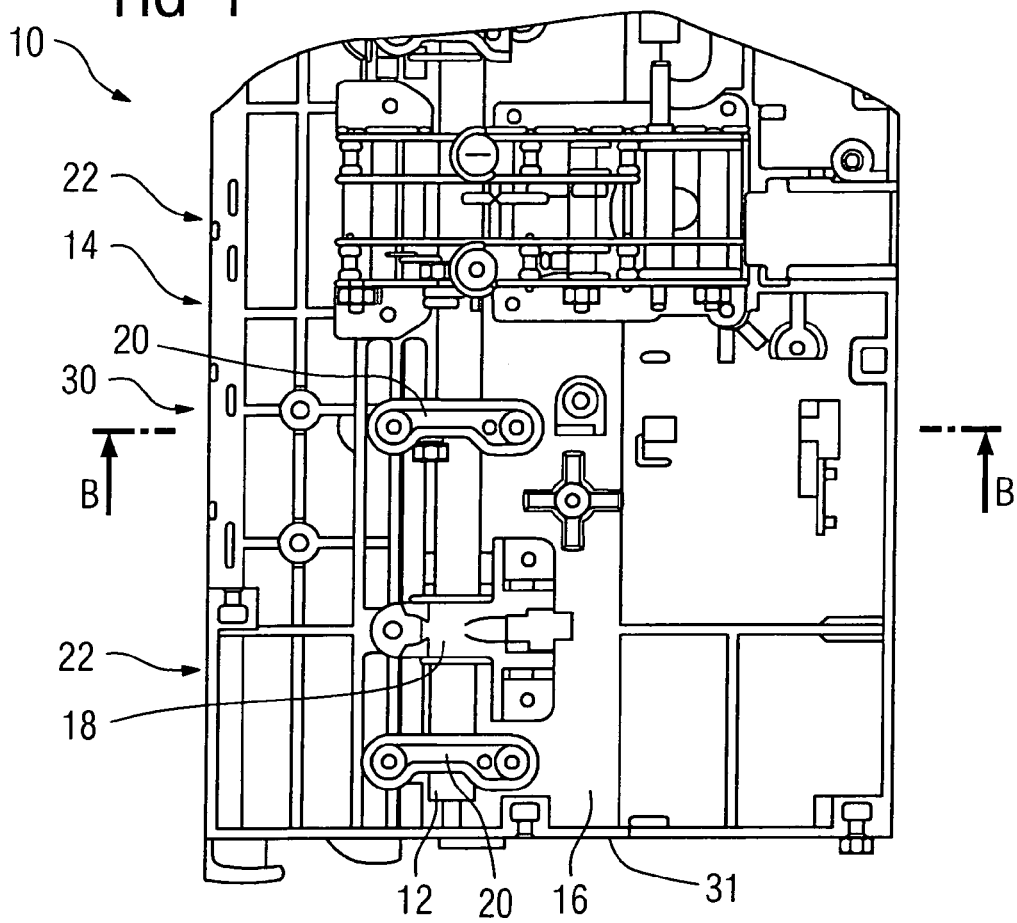
FIG. 1 shows a power circuit breaker having switching shaft mounts.

FIG. 1 shows a detail of an illustration of a power circuit breaker 10 according to an embodiment of the invention. The power circuit breaker 10 includes a multi-part switching pole enclosure 14 (of which only one first enclosure shell 16, which is in the form of a front wall, is visible) three switching poles 22, a switching shaft 12 and switching shaft mounts 18, 20. Pole partitions 30 run between the switching chambers of the switching poles 22 such that each of the switching poles 22 is accommodated in a switching pole chamber. In addition, outer side walls 31 formed by the two enclosure shells 16, 24 contribute to the formation of the outer switching pole chambers.

Figure 2:
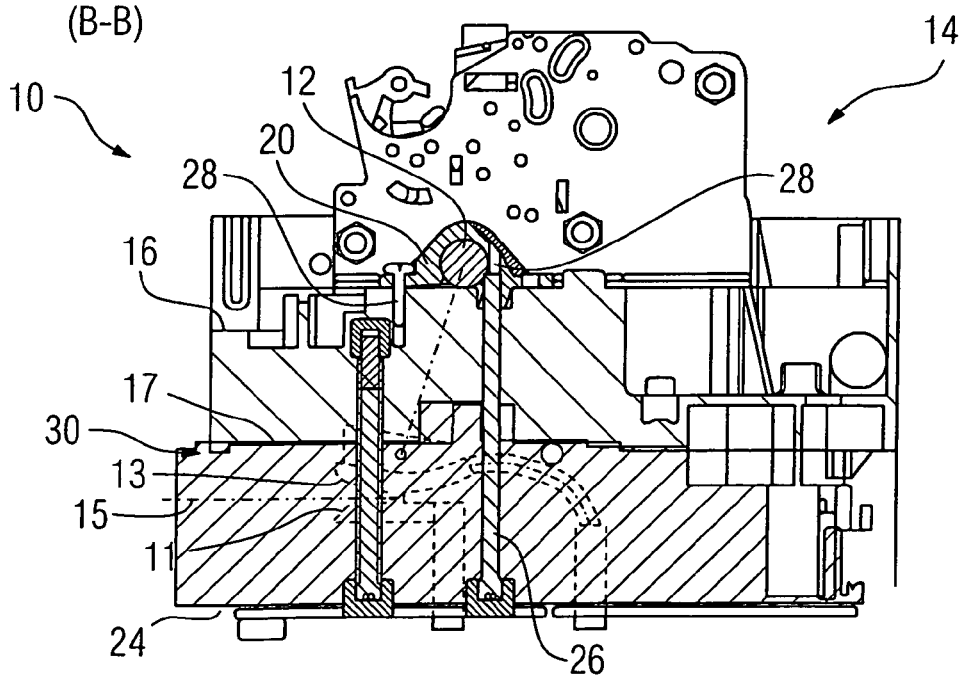
FIG. 2 shows a section through the power circuit breaker shown in FIG. 1.

FIG. 2 shows a section through the power circuit breaker 10 in FIG. 1 along the line B—B, which intersects one of the switching shaft mounts 20 and runs through a pole partition 30. Switching contacts 11 and 13 of the switching poles 22 make contact in a specified contact plane 15 when in the closed position as shown herein. Fastening device 26 in the form of tie rods, which extend from the second enclosure shell 24 through the first enclosure shell 16 to the respective switching shaft mount 20 and are each arranged in a pole partition 30, serve the purpose of connecting the switching shaft mounts 20 to a second enclosure shell 24, which is in the form of a rear wall, of the enclosure 14. The two enclosure shell 16 and 24 fit against each other along a separation joint 17, extending essentially parallel to the contact plane 15. The tie rods and the switching shaft mounts 20 are each connected by way of a screw connection 28.

On the opposite side of each of the switching shaft mounts 20, the power circuit breaker 10 has a further screw connection 28 for the purpose of connecting the switching shaft mount 20 to the first enclosure shell 16. The switching shaft mounts 20 cause the switching shaft 12 to bend, the force flowing via the second enclosure shell 24, the fastening device 26 and the screw connection 28 to the thread of the switching shaft mounts 20 and finally to the switching shaft 12. As a result, the load is reduced on the first enclosure shell 16, which, for geometrical reasons, can be designed such that it is not as robust as the second enclosure shell 24. The design of the power circuit breaker 10 according to an embodiment of the invention, which is subject to little deformation, makes it possible for the power circuit breaker 10 to withstand high surge currents with low contact forces.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A power circuit breaker, comprising:

a switching pole enclosure for accommodating at least one switching pole, whose switching contacts, when closed, rest against one another on a predetermined contact plane; and a switching shaft for transferring drive forces to the at least one switching pole, wherein the switching pole enclosure includes a first and a second enclosure shell which rest against one another along a separating joint running essentially parallel to the contact plane, and wherein the switching shaft is mounted by at least two switching shaft mounts held on the first enclosure shell; and at least one fastening means, for connecting the two enclosure shells, the at least one fastening means being supported on the second enclosure shell and at least one fastening means being supported on one of the switching shaft mounts.

2. The power circuit breaker as claimed in claim 1, wherein the second enclosure shell is ribbed.

3. The power circuit breaker as claimed in claim 2, wherein the switching pole enclosure includes pole partitions for physically separating adjacent switching poles, wherein the two enclosure shells form outer side walls, and wherein at least one of the fastening means extends in at least one of one of the pole partitions and one of the side walls.

4. The power circuit breaker as claimed in claim 2, wherein tie rods are provided as the fastening means.

5. The power circuit breaker as claimed in claim 1, wherein the switching pole enclosure includes pole partitions for physically separating adjacent switching, poles, wherein the two enclosure shells form outer side walls, and wherein at least one of the fastening means extends in at least one of one of the pole partitions and one of the side walls.

6. The power circuit breaker as claimed in claim 5, wherein tie rods are provided as the fastening means.

7. The power circuit breaker as claimed in claim 1, wherein tie rods are provided as the fastening means.

8. A power circuit breaker, comprising:

means for accommodating at least one switching pole, whose switching contacts, when closed, rest on a predetermined contact plane; and means for transferring drive forces to the at least one switching pole, wherein the means for accommodating includes a first and a second enclosure shell which rest against one another along a separating joint running essentially parallel to the contact plane, and wherein the means for transferring is mounted by at least two switching shaft mounts held on the first enclosure shell; and at least one fastening means, for connecting the two enclosure shells, at least one fastening means being supported on the second enclosure shell and at least one fastening means being supported on one of the switching shaft mounts.

9. The power circuit breaker as claimed in claim 8, wherein the second enclosure shell is ribbed.

10. The power circuit breaker as claimed in claim 9, wherein the means for accommodating includes pole partitions for physically separating adjacent switching poles, wherein the two enclosure shells form outer side walls, and wherein at least one of the fastening means extends in at least one of one of the pole partitions and one of the side walls.

11. The power circuit breaker as claimed in claim 9, wherein tie rods are provided as the fastening means.

12. The power circuit breaker as claimed in claim 8, wherein the means for accommodating includes pole partitions for physically separating adjacent switching poles, wherein the two enclosure shells form outer side walls, and wherein at least one of the fastening means extends in at least one of one of the pole partitions and one of the side walls.

13. The power circuit breaker as claimed in claim 12, wherein tie rods are provided as the fastening means.

14. The power circuit breaker as claimed in claim 8, wherein tie rods are provided as the fastening means.

* * * * *